United States Patent [19]

Bannon

[11] 4,359,380

[45] Nov. 16, 1982

[54] ADSORPTION PROCESS

[75] Inventor: Robert P. Bannon, Houston, Tex.

[73] Assignee: Shell Oil Company, Houston, Tex.

[21] Appl. No.: 182,331

[22] Filed: Aug. 29, 1980

[51] Int. Cl.[3] ..... C10G 25/03

[52] U.S. Cl. ..... 208/310 Z; 585/826

[58] Field of Search ..... 208/310 Z; 585/820, 585/826

[56] References Cited

U.S. PATENT DOCUMENTS 2,985,589 5/1961 Broughton et al. ..... 210/34

3,451,924 6/1969 Helfferich et al. ..... 208/310 Z 4,238,321 12/1980 Florack ..... 208/310 Z

*Primary Examiner*—Delbert E. Gantz

*Assistant Examiner*—William Leader

[57] ABSTRACT

A continuous, cyclic, vapor-phase adsorption process for the separation of normal paraffins from a hyrocarbon feed mixture, providing improved efficiency of separation and continuity of product flows. For purposes of this process, a continuous flow of the feed mixture and a continuous flow of an eluent are passed in repetitions of a particular sequence of six process steps to at least three molecular sieve adsorbent beds.

7 Claims, 2 Drawing Figures

ADSORPTION PROCESS

BACKGROUND OF THE INVENTION

This invention relates to an improved continuous adsorption process for the resolution of hydrocarbon mixtures into products of like molecular structure. More particularly, this process relates to the application of multiple molecular sieve adsorbent beds to the separation of normal paraffins from a vapor-phase hydrocarbon mixture containing the same.

It is recognized that resolution of the components of certain fluid solutions can be achieved through exploitation of the adsorptive properties of materials commonly known as molecular sieves. Such materials, principally the natural and synthetic aluminosilicates, have a porous crystalline structure with intracrystal cavities that are accessible via pores of relatively uniform diameter. Adsorption through the pores is selective—only molecules with an effective diameter smaller than the characteristic pore diameter of a particular molecular sieve can be adsorbed thereby. Thus, a basis is provided for separation of molecules according to size. Molecular sieves are particularly useful for accomplishing the separations of mixtures of hydrocarbons of differing molecular structures, for instance the separation of normal paraffins from mixtures also comprising branched and/or cyclic hydrocarbons, which separations are not generally feasible through more common techniques such as fractional distillation or solvent extraction.

In the application of a molecular sieve to such separations, a mixed feedstock is passed over a contained bed of the sieve material to accomplish adsorption thereon of selected molecules, termed the adsorbate fraction of the feedstock. Effluent from the bed comprises the remaining fraction of the feedstock, herein termed the raffinate. Adsorption is, of course, but one phase of the overall separation process, since the adsorbate must eventually be desorbed from the sieve. One common method for accomplishing such desorption involves discontinuing the flow of feedstock and passing a stream of an eluent over the bed. The eluent is generally a compound which is itself adsorbed through the sieve pores. For instance, when the adsorbate is a normal paraffin of a given carbon number, a preferred eluent is a normal paraffin of a different carbon number. In this case both the adsorption and desorption phases of the overall separations process involve interchange of eluent and adsorbate molecules on the sieve bed—adsorbate molecules are displaced from the sieve pores by eluent molecules during the desorption step and eluent is displaced by adsorbate during a subsequent adsorption step. A mixture of raffinate and eluent molecules is withdrawn as effluent from the bed during adsorption service by the bed, and a mixture of adsorbate and eluent is withdrawn during desorption. Such effluent mixtures, respectively termed the process raffinate and adsorbate products, are generally then subjected to further processing for the recovery of eluent for recycle to the adsorption beds.

With respect to the use of a given sieve bed for separations purposes, the performance of distinct adsorption and desorption steps does not permit a continuous process as is often desired for efficient commercial operations. It is recognized, however, that certain discontinuities associated with the use of a single bed can be eliminated and other processing advantages realized through the use of multiple sieve beds.

In the context of vapor-phase adsorption processes for the separation of normal paraffins from hydrocarbon mixtures, one such multi-bed process which has proven to be of particular advantage is that of U.S. Pat. No. 3,451,924. Through repeated switching of process flows to three adsorbent beds in a 6 step sequence, the process of this patent achieves continuity with respect to the flow of both hydrocarbon feed and eluent to the beds. Furthermore, through series flow of certain process streams through two adsorbent beds, the process provides for loading of each adsorbent bed to near full capacity without loss of the normal paraffins to the process raffinate product.

The prior art process of U.S. Pat. No. 3,451,924 can be more particularly described through reference to attached FIG. 1, which in six parts, labeled (a) through (f), illustrates schematically each of the six process steps. Referring to FIG. 1(*a*), depicted therein is a step of the process in which a continuous flow of a vapor-phase normal paraffin-containing mixed hydrocarbon feed stream designated 10 is passed to a first sieve bed designated A which functions as a primary adsorption bed to adsorb said feed normal paraffins. Effluent, stream 11, is withdrawn from bed A and passed to another bed labeled B which serves as a secondary adsorption bed, capturing normal paraffins which escape adsorption in, or "breakthrough", sieve bed A. A process raffinate product, stream 20, composed primarily of non-normal paraffin hydrocarbons from the feed and of eluent, is withdrawn from bed B. This raffinate mixture is typically separated into an eluent fraction and a non-normal paraffin hydrocarbon fraction by downstream processing facilities not a part of the adsorption process and not here shown. The separated eluent fraction is usually recycled. Also during the process step depicted in FIG. 1(*a*), a continuous flow of eluent 30 is passed to a previously loaded bed C for desorption of normal paraffins therein. A process adsorbate product 40 is withdrawn from bed C. This adsorbate product is then typically separated into a feed normal paraffin fraction and an eluent fraction by downstream processing facilities not shown, and the eluent recycled to the adsorption process.

The prior art process step depicted in FIG. 1(*a*) is continued until bed A is loaded to substantially full capacity with adsorbate and desorption of bed C is essentially complete, at which time process flows are switched to the step of FIG. 1(*b*). Now, referring to this Figure, the continuous flow of hydrocarbon feed, again designated 10, is passed directly to sieve bed B which serves as a sole adsorption bed for this process step. The continuous eluent flow 30 is passed to bed A to purge non-adsorbed feed hydrocarbons from the void spaces therein. Since the purge effluent stream 31 from purge bed A contains quantities of unadsorbed and desorbed normal paraffins, it is passed to freshly desorbed bed C which serves as a purge guard bed wherein these normal paraffins can be captured. Effluent from bed B and effluent from bed C, both composed substantially of feed non-normal paraffin hydrocarbons and eluent, may be combined as shown into a single raffinate product 20. Alternatively, the two effluent streams may be maintained as separate raffinate products for downstream use or processing. There is no process adsorbate product stream during the process step of FIG. 1(*b*).

Once bed A has been effectively purged of non-normal paraffin hydrocarbons, process flows are switched to the step illustrated in FIG. 1(*c*). This step is in principle very similar to that of FIG. 1(*a*), as is indicated by process stream designations common to the two figures. Here, however, bed A is the desorption bed, bed B is the primary adsorption bed, and bed C is the secondary adsorption bed. The process is in turn switched to the steps of FIGS. 1(*d*), 1(*e*), and 1(*f*). Upon completion of the step of FIG. 1(*f*), the process is switched to that of FIG. 1(*a*). The six step process sequence is continuously repeated in this manner as many times as is desired. The serivce of each bed in each of the six process steps is summarized in Table I:

TABLE I

| The step of: | bed A | bed B | bed C |
|---|---|---|---|
| FIG. 1(a) | primary adsorption | secondary adsorption | desorption |
| FIG 1(b) | purge | sole adsorption | purge guard |
| FIG. 1(c) | desorption | primary adsorption | secondary adsorption |
| FIG 1(d) | purge guard | purge | sole adsorption |
| FIG. 1(e) | secondary adsorption | desorption | primary adsorption |
| FIG. 1(f) | sole adsorption | purge guard | purge |

In view of the continuous cyclic nature of this process, it has been termed the "Merry-Go-Round" process.

Despite the commercial success which the process of U.S. Pat. No. 3,451,924 has enjoyed, there are a number of disadvantages associated with its operation and performance. For instance, it is observed through reference to FIG. 1 that there is no process adsorbate product stream during three of the six process steps. In the process steps depicted in FIGS. 1(*a*), 1(*c*) and 1(*e*), there is a process raffinate product 20 which closely corresponds in mass flowrate to the hydrocarbon feed. In addition, there is also during these three steps, a process adsorbate product 40 which closely corresponds in mass flowrate to the eluent stream. However, in the steps of FIGS. 1(*b*), 1(*d*), and 1(*f*), there is only a raffinate product stream which corresponds in mass flowrate to the sum of that of the feed and eluent streams. Downstream processing of such vapor-phase product streams which are subject to repeated discontinuities in flowrate and composition has proved most difficult. For example, it has been impossible to implement efficient heat conservation measures or fully stable downstream processes for eluent recovery from adsorbate and raffinate product streams.

Furthermore, the use of a freshly desorbed sieve bed for purge guard service in the prior art process steps of FIGS. 1(*b*), 1(*d*), and 1(*f*) has adverse affects upon the performance of this same bed in immediately subsequent adsorption service. The purge stream contains not only the non-normal paraffin feed hydrocarbons that are being purged from the purge bed voids but also a considerable amount of feed normal paraffins which were eluted from the purge bed by the purge eluent flow. In the prior art process the feed normal paraffins are adsorbed from the purge effluent stream by the front part of the purge guard bed. However, the purge guard bed is next switched to secondary adsorption service, where the flow to the bed is for the most part a mixture of non-normal paraffin feed hydrocarbons and eluent desorbed from the primary adsorption bed. The eluent in this flow tends to broaden the adsorption front in the secondary bed by desorbing feed normal paraffins from the front part of the bed which, in turn, are then readsorbed further downstream in the bed where the concentration of feed n-paraffins is lower. As a consequence at the time the bed is switched from secondary adsorption to primary adsorption, the feed normal paraffins are not adsorbed in a sharp adsorption front near the inlet to the sieve bed, but instead are spread throughout the bed. When hydrocarbon feed is passed over the bed during its subsequent primary adsorption service, breakthrough of feed normal paraffins into the bed effluent is encountered well before the bed is substantially loaded.

SUMMARY OF THE INVENTION

The instant invention provides an improved multibed continuous cyclic vapor-phase process for the separation of normal paraffins from a hydrocarbon mixture containing normal paraffins and non-normal paraffin hydrocarbons, which substantially alleviates the aforementioned problems associated with the prior art. According to the invention, a continuous flow of a feed mixture and a continuous flow of an eluent are passed in repetitions of a particular sequence of six process steps to at least three adsorbent beds to accomplish separation of the mixture into an adsorbate product fraction comprising normal paraffins and a raffinate product fraction comprising non-normal paraffin hydrocarbons. The process steps may be described as follows:

step one, in which
- the feed mixture is passed through a first adsorbent bed,
- effluent is withdrawn from the first bed and passed through a second adsorbent bed,
- the eluent flow is passed through a third adsorbent bed,
- adsorbate product is withdrawn as an effluent from the third bed, and
- raffinate product is withdrawn as an effluent from the second bed;

step two, in which
- the feed mixture is passed through the second bed,
- the eluent flow is passed through the third bed,
- effluent from the third bed is withdrawn and divided into an adsorbate product fraction, which contains between 60 and 95 volume percent of the effluent from the third bed, and a purge fraction which contains between 5 and 40 volume percent of the effluent from the third bed,
- the purge fraction is passed through the first bed,
- effluent from the first bed is withdrawn and is passed through the second bed, and
- raffinate product is withdrawn as effluent from the second bed;

step three, in which
- the feed mixture is passed through the second bed,
- effluent is withdrawn from the second bed and passed through the third bed,
- the eluent flow is passed through the first bed,
- adsorbate product is withdrawn as an effluent from the first bed, and
- raffinate product is withdrawn as an effluent from the third bed;

step four, in which
- the feed mixture is passed through the third bed,
- the eluent flow is passed through the first bed, effluent from the first bed is withdrawn and divided into an adsorbate product fraction, which contains between 60 and 95 volume percent of the effluent from the first bed, and a purge fraction which contains between 5 and 40 volume percent of the effluent from the first bed, the purge fraction is passed through the second bed, effluent from the second bed is withdrawn and is passed through the third bed, and raffinate product is withdrawn as effluent from the third bed;

step five, in which the feed mixture is passed through the third bed, effluent is withdrawn from the third bed and passed through the first bed, the eluent flow is passed through the second bed, adsorbate product is withdrawn as an effluent from the second bed, and raffinate product is withdrawn as an effluent from the first bed; and step six, in which the feed mixture is passed through the first bed, the eluent flow is passed through the second bed, effluent from the second bed is withdrawn and divided into an adsorbate product fraction, which contains between 60 and 95 volume percent of the effluent from the second bed, and a purge fraction, which contains between 5 and 40 volume percent of the effluent from the second bed, the purge fraction is passed through the third bed, effluent from the third bed is withdrawn and is passed through the first bed, and raffinate product is withdrawn as effluent from the first bed.

In practice, the separation process of the invention has the advantages which have characterized the conventional multi-bed molecular sieve adsorption process of U.S. Pat. No. 3,451,924. As with this known process, the invention can be carried out using continuous flows of both feedstock and eluent to the beds. The invention likewise provides a secondary adsorption bed which prevents the breakthrough of normal paraffins into the raffinate product as the primary adsorption bed nears full capacity.

Additionally, practice of the process of the invention provides numerous substantial advantages over the prior art. Most significantly, the invention provides an uninterrupted flow of adsorbate product throughout the process and a composition in both raffinate and absorbate products that is more clearly constant throughout the repeated sequential switching between the various process steps. These aspects of the invention make possible a more stable operation of downstream processing equipment, including more efficient energy conservation.

The invention affords still further benefit over the process of U.S. Pat. No. 3,451,924 through elimination of the previously-described disadvantage associated with purge guard bed duty by a freshly desorbed sieve bed. In the process of the invention, the purge bed effluent, of relatively small flowrate, is passed in admixture with larger quantities of hydrocarbon feedstock to the sole adsorption bed. Under such operation, the purge bed effluent does not have substantial adverse effect upon the character of the adsorption front in any bed.

By eliminating the prior art purge guard service of a freshly desorbed bed, the invention provides a longer time period over which desorption can be performed—desorption of each bed spans two of the six process steps. This advantage over the art may also be to some extent achieved by alternative practice according to the related process that is the invention described in the copending application, Ser. No. 166,653, filed July 7, 1980, having common inventorship. However, in the invention of the prior application, only part of the eluent flow was passed to the bed under desorption during one of the two steps in which it was desorbed, the remainder being used to purge a loaded bed. It is considered of substantial benefit with respect to more complete desorption of a loaded bed that in the process of the present invention each bed receives the full eluent flow for desorption purposes over two of six process steps and receives a greater total quantity of eluent flow than in the process of U.S. Pat. No. 3,451,924 or that of the copending application. In addition, somewhat higher bed loadings are possible in many cases in the process of the present invention, in comparison to that of the copending application.

DESCRIPTION OF THE PREFERRED EMBODIMENTS

Figure 1A:
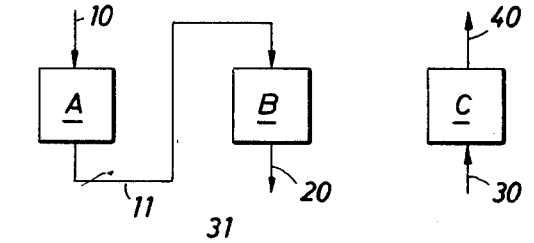
(PRIOR ART) FIG. 1(a)
FIG. 1 shows the sequence of process steps according to the prior art.
Figure 1B:
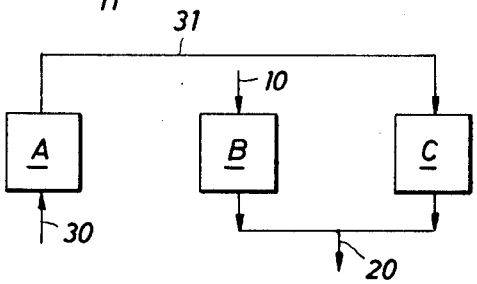
Figure 1C:
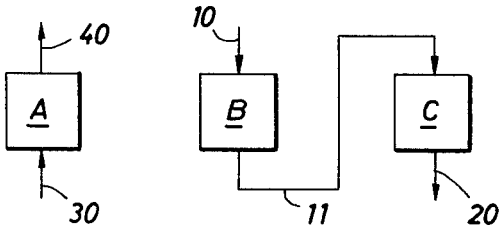
Figure 1D:
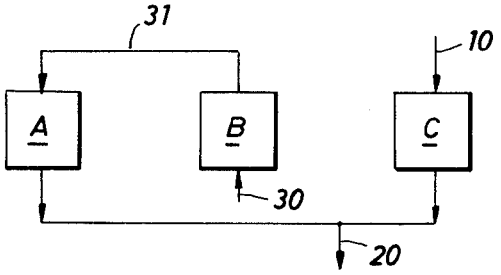
Figure 1E:
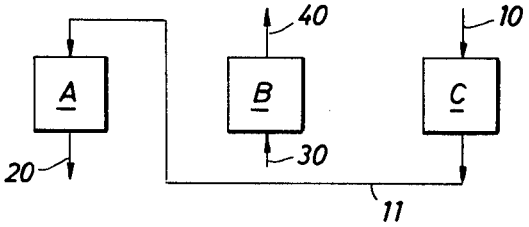
Figure 1F:
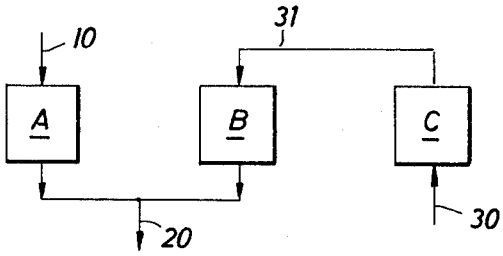

The invention summarily described above can be more fully illustrated through reference to the attached FIG. 2. Schematically depicted therein is the operation of three molecular sieve beds, designated A, B, and C, through a sequence of six process steps each of which is individually shown in the parts of FIG. 2 labeled (*a*) through (*f*).

Looking first to FIG. 2(*a*), illustrated therein is step one of a cyclic process according to the invention, in which step a continuous flow of a vapor-phase normal paraffin-containing hydrocarbon feed stream designated 210 is passed to sieve bed A which functions as a primary adsorption bed to adsorb said normal paraffins. Effluent, stream 211, is withdrawn from bed A and passed to a second bed B which serves as a secondary adsorption bed, capturing feed normal paraffins which break through sieve bed A. A process raffinate product, stream 220, with a feed normal paraffin content substantially reduced from that of stream 210, is withdrawn from bed B. Also during the process step depicted in FIG. 2(*a*), a continuous flow of eluent vapor 230 is passed to bed C, which has been previously loaded with feed normal paraffins, for desorption thereof from the sieve. A process adsorbate product 240, containing essentially feed normal paraffins and eluent, is withdrawn from this desorption bed.

The process step depicted in FIG. 2(*a*) is continued until bed A is loaded to substantially full capacity with feed normal paraffins, at which time the process is switched to step two illustrated by FIG. 2(*b*). Referring to this Figure, desorption of bed C continues during this step of the process as the eluent flow is passed therethrough and an effluent stream 238 is withdrawn. The continuous flow of this effluent 238 from bed C is divided into two streams, an adsorbate product fraction, stream 240, comprising between 60 and 95 percent by volume of the total effluent flow and a purge fraction, stream 239, comprising the remainder. The purge fraction is passed through bed A to purge non-adsorbed feed hydrocarbons from the void spaces therein. Purge effluent 250 from bed A, containing a significant quantity of normal paraffin, is passed to the inlet of bed B which in this step of the process functions as a sole adsorption bed also receiving hydrocarbon feed mixture 210. Stream 250 and stream 210 may be introduced into bed B either individually or in combination. Raffinate product 220 is withdrawn from bed B.

Step two is continued until bed A has been effectively purged of non-normal paraffin feed hydrocarbons and desorption of bed C is substantially complete, at which time process flows are switched to step three shown in FIG. 2(*c*). During this step, the continuous flow of feed mixture 210 is passed to primary adsorption bed B. Effluent stream 211 from bed B is passed to freshly desorbed bed C which now is in secondary adsorption service. Raffinate product 220 is withdrawn from bed C. Bed A undergoes desorption as the full eluent flow 230 is introduced to this bed and adsorbate product 240 is withdrawn.

Once bed B has been substantially loaded with feed normal paraffin through operation of step three, the process is switched to step four, as illustrated by FIG. 2(*d*). In this step, flow of eluent 230 through bed A continues, for desorption therefrom of adsorbed normal paraffins. Desorption bed effluent 238 is withdrawn from bed A and again here divided into an absorbate product fraction 240, comprising between 60 and 95 percent by volume of the total, and a purge fraction 239, comprising the remainder. The purge fraction is passed through bed B. Effluent 250 is withdrawn from bed B and, together with the feed stream 210, is passed to bed C which functions as sole adsorption bed for capture of normal paraffins. Raffinate product 220 is withdrawn from bed C.

Upon completion of the purge of bed B and the desorption of bed A in step four, the process is switched to step five as shown in FIG. 2(*e*). In step five, the continuous feed stream 210 is directed to primary adsorption bed C. Effluent 211 from this bed is passed to secondary adsorption bed A. Raffinate product 220 is withdrawn from bed A. Full eluent flow 230 is passed to bed B, and adsorbate product 240 is withdrawn from this bed.

Step five is continued until bed C is substantially loaded with feed normal paraffin, at which time the process flows are switched to the configuration of step six, illustrated by FIG. 2(*f*). For purposes of this process step, the feed mixture 210 is introduced into sieve bed A and the eluent 230 continues to be passed to bed B. Effluent 238 from bed B is divided into an adsorbate product fraction 240, comprising 60 to 95 percent of the total, and a purge fraction 239, comprising the remaining 5 to 40 percent. The purge fraction is passed through bed C to purge non-adsorbed feed hydrocarbons from the bed void volumes. Effluent 250 is withdrawn from bed C and introduced into bed A, which functions as sole adsorption bed during this process step. Raffinate product 220 is withdrawn from bed A.

Upon completion of step six, i.e., when feed normal paraffins have been effectively desorbed from bed B and non-normal paraffin hydrocarbons have been purged from bed C, the process of invention has undergone one full cycle. Process flows are now switched to step one and the sequence of steps one through six repeated in the manner described above as many times as is desired.

The functions of each of the three sieve beds in each of the six process steps of the invention are recited in Table II.

TABLE II

| | bed A | bed B | bed C |
|---|---|---|---|
| Step one | primary adsorption | secondary adsorption | desorption |
| Step two | purge | sole adsorption | desorption |
| Step three | desorption | primary adsorption | secondary adsorption |
| Step four | desorption | purge | sole adsorption |
| Step five | secondary adsorption | desorption | primary adsorption |
| Step six | sole adsorption | desorption | purge |

For the sake of clarity, FIG. 2, through which the invention is described above, omits a detailed showing of the full array of interconnecting flow conduits, valves, and optional instrumentation which are employed to switch the process flows through the invention's full cycle of six steps. The description of the invention herein also omits detailed description of known procedures for the use of one or more beds in addition to the three required for practice of the invention to enable periodic regeneration of each bed. For instance, a fourth adsorbent bed can be provided so that process continuity is maintained during regeneration of one bed, in which case the six step process description applies to the remaining three beds which are utilized at any given time for adsorption, desorption and purge service. Such equipment and procedures and their operation are considered obvious to one skilled in the art and thus do not require elaborate description herein.

It is critical to the process of the invention that during steps two, four, and six, as above-described, the effluent flow from the bed undergoing desorption is divided to provide for both an adsorbate product stream and a flow of purge fluid to the bed undergoing a purge of non-normal hydrocarbons. The division of this flow is necessarily such that between about 5 and 40 percent of the eluent flow during these steps is provided as the purge stream and the remaining approximately 60 to 95 percent is taken as adsorbate product. The practical limits upon the division of this flow into adsorbate product and purge are determined by consideration of the minimum volume of purge flow which is necessary to fill the void space of the purge bed and of the maximum desirable combined flow of purge effluent and feedstock to the sole adsorption bed, the latter of which is itself based upon such factors as efficiency of adsorption by the bed, attrition of sieve material, lifting of the bed if operated with upflow, etc. Preferably, the process of the invention is operated such that purge flow is between about 10 and 35 volume percent of the total desorption bed effluent flow in steps two, four, and six. Most preferably, purge flow during these steps is between about 15 and 30 volume percent of total desorption effluent, the remaining 70 to 85 volume percent being taken as adsorbate product.

Simultaneous purge and desorption, according to steps two, four, and six of the invention, was not practiced in related prior art adsorption processes. In either the process of the invention or that of the prior art, purge of a loaded bed before its desorption continues only so long as the sole adsorption bed is able to prevent substantial breakthrough of normal paraffins into the raffinate product. During practice of the process of the invention, the adsorption front in the sole adsorption bed is sharper, breakthrough is delayed, and greater portions of the process sequence can be devoted to purge and desorption. In comparison to the prior art, then, the desired quantity of total purge eluent vapor can now be supplied to the purge bed over a longer time period and thus at a lower flowrate. Accordingly, the flowrate of purge eluent through a given purge bed during practice of the invention is only 5 to 40 percent of that called for by the prior art.

Figure 2A:
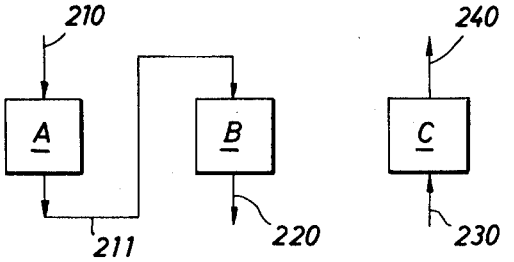
FIG. 2 shows the sequence of process steps according to the invention.
Figure 2B:
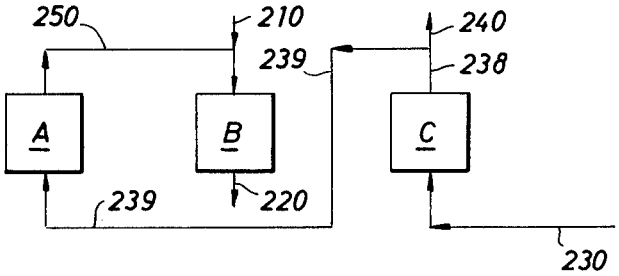
Figure 2C:
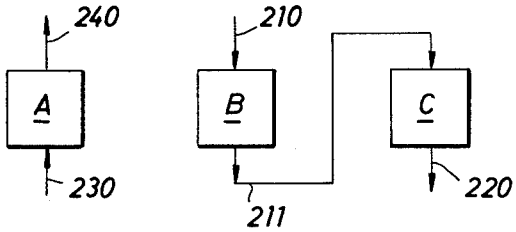
Figure 2D:
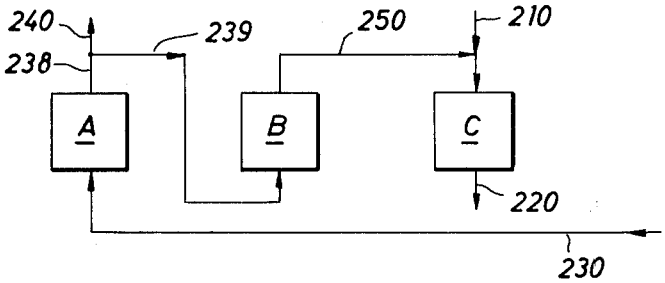
Figure 2E:
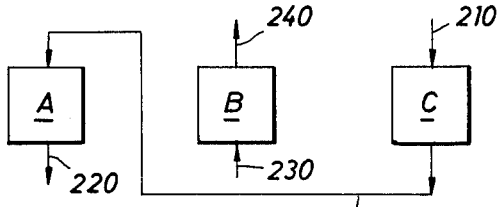
Figure 2F:
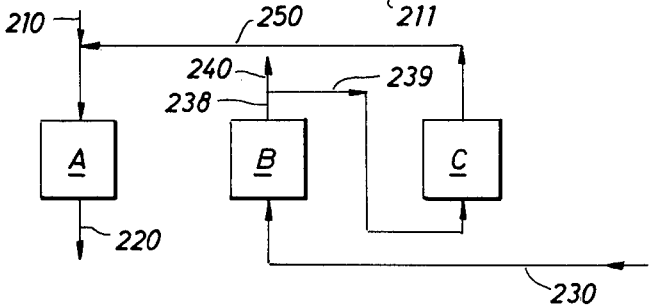

In distinction with the alternative multi-step adsorption process of the above-referenced copending application, the process of the invention utilizes for purge service a part of the flow of effluent from a bed in desorption service rather than a part of the flow of eluent into the desorption bed. It will be observed that the invention thus entails the recycle of some potential adsorbate product, containing recoverable feed normal paraffins, back into the process. Still it is not the case, as might be expected, that these paraffins are lost or that the process efficiency suffers as a result of this recycle. For a representative illustration of process function in this regard, reference is again made to FIGS. 2(*a*) and 2(*b*), schematically depicting what are herein termed process steps one and two. It will be observed from FIG. 2(*b*) that feed normal paraffins contained in purge stream 239, a division as specified from the effluent of bed C, are eventually re-captured when purge effluent 250 from bed A is passed through adsorption bed B. Furthermore, the purge stream 239 in the process step shown in FIG. 2*b* is divided from a desorption effluent which has a lower than average concentration of the normal paraffins which it is the object of the invention to recover from the hydrocarbon feed mixture. Before a part of the desorption bed C effluent is routed to purge service in step two, bed C has previously undergone desorption with full eluent flow for a complete process step, herein step one as shown by FIG. 2(*a*). A majority of the feed normal paraffins loaded onto bed C are desorbed during step one and only a substantially smaller portion thereof remain for removal by desorption during step two. Still further, it will be observed that in purging bed A of the feed non-normal paraffin hydrocarbons in the sieve void volume, there is accomplished a partial elution of adsorbed feed normal paraffins with the purge fluid. When the purge fluid itself contains desired feed normal paraffins in addition to eluent, the amount of elution is lessened to result in a total bed content of feed normal paraffin, in both the sieve pores and in the void spaces, that is higher than obtainable when using as purge an eluent not containing feed normal paraffins. In practice, this higher bed loading effect, together with the more complete desorption of the bed resulting from introduction of full eluent flow over two complete process steps, reduces the quantity of eluent needed for process operation at a given production rate of feed normal paraffins. Alternatively, the invention can be practiced in a manner so as to provide enhanced processing capacity for normal paraffin-containing feedstock at a given eluent flow.

For purposes of practice of the cycle of process steps of the invention described above, it is necessary that consideration be given to such matters as the type and amount of molecular sieve to be employed to the multiple adsorption beds, the operating temperatures and pressures of the beds and the several process vapor streams, the flowrates and compositions of feed and eluent, and the periodic regeneration of each sieve bed. Generally, it can be said that the influence of these matters upon the operation of the process of the invention is not significantly different from their influence upon related prior art multiple bed molecular sieve adsorption processes. In other words, the process of the invention is in essence seen to alter only the sequence of process steps for the use of multiple sieve beds in the separation of normal paraffins from a mixed vapor-phase hydrocarbon feed, and not to necessitate material change in the parameters recognized by the prior art as suitable for operation of any individual sieve bed. Thus, selection of such operating parameters and general procedures for the process of the invention can be made on the basis of principles well known in the art. For instance, suitable and preferred operating parameters for use in the separation of normal paraffins having from about 5 to 30 carbon atoms, and particularly those having from about 11 to 15 carbon atoms, from non-normal paraffin hydrocarbons are described in U.S. Pat. No. 3,451,924, the teachings of which are incorporated herein by reference. It should be noted, however, that the process of this invention calls for the flow of a quantity of eluent through all three adsorbent beds in series. For this reason, particular consideration must be given to providing a supply of eluent at a pressure which may well need to be in excess of eluent supply pressures characteristic of related prior art processes in which there is flow of eluent only through at most two beds in series.

Further illustration of the process of the invention and a comparison with prior art may be realized through the following Example and Comparative Example.

COMPARATIVE EXAMPLE

According to the process of U.S. Pat. No. 3,451,924, as described above with reference to FIG. 1, three molecular sieve adsorption beds, each containing about 120,000 lbs. of a type 5A molecular sieve, are utilized to separate a vapor phase $C_{11}$ to $C_{14}$ kerosene stream of continuous and constant flowrate (882 lb moles per hour) into a normal paraffin-containing adsorbate product and a non-normal paraffin-containing raffinate product. A continuous and constant flow (1359 lb moles per hour) of normal octane eluent is supplied to the process. The temperature of all process flows and all beds is about 660° F. Feed enters the process at a pressure of approximately 42 psig; eluent is supplied at a pressure of about 65 psig. Process flows for this comparative example are further described in Table III. In actual practice for separation of a typical kerosene feedstock, the process of this comparative example yields an adsorbate product (average flow of about 1110 lb moles per hour) containing about 90 percent of the normal paraffins present in the feedstock and a raffinate product (average flow of approximately 1131 lb moles per hour) comprising substantially all of the feedstock's non-normal paraffin hydrocarbons.

EXAMPLE

The same three molecular sieve adsorbent beds described in the above comparative example can be used in accordance with the process of the invention for normal paraffin recovery from the same continuous flow of kerosene feedstock. Process temperatures and pressures are also the same as are described in the comparative example. A normal octane stream of a constant 1359 lb moles per hour would again be used as eluent.

In the steps of the process of the invention herein designated steps two, four, and six, effluent from the bed in desorption service must be divided into an adsorbate product fraction and a purge fraction. For purposes of this example a division in these steps such that about 80% of the desorption bed effluent is taken as adsorbate product and about 20% of the desorption bed effluent is employed for purge is considered near optimal.

Under practice according to this example of the invention the quality of the separation of feedstock into a normal paraffin-containing adsorbate product and a non-normal paraffin-containing raffinate product would be at least equivalent to that obtained through operation of the above prior art comparative example. Additionally, the continuity of the process product flows is substantially improved in comparison to the prior art. For instance, reference to Table III indicates that, whereas in the comparative example, not operated in accordance with the invention, the process adsorbate flowrate repeatedly undergoes discontinuous change between 0 lb moles per hour and 1249 lb moles per hour, in this example of the invention the corresponding change would only be between about 960 and 1260 lb moles per hour. Likewise, raffinate flow in the process of this example according to the invention would vary only between about 980 and 1282 lb moles per hour in contrast to the 980 to 2339 lb moles per hour variations encountered in practice of the prior art comparative example. Like contrasts between the performance of the invention and that of the prior art can be drawn with regard to continuity of composition in the product streams. For instance, in process steps one, three, and five, the raffinate product of the comparative example is substantially non-normal paraffin hydrocarbons, while in steps two, four, and six the raffinate is principally composed of normal octane eluent. Composition in the raffinate is much more nearly constant through all steps of the example according to the invention and is always primarily non-normal paraffin hydrocarbons. Such improvements in operation, both with respect to the continuity of product flows and compositions, are solely the result of practice according to the novel sequence of process steps that is the present invention—all other aspects of operation of the three molecular sieve beds are the same in the example according to the invention and in the comparative example according to the prior art.

TABLE III

| | (Process flows in lb moles per hour) | | |
|---|---|---|---|
| | Process steps 1, 3, 5 | Process steps 2, 4, 6 | Average |
| adsorbate product | | | |
| comparative example | 1249 | 0 | 1110 |
| example | 1260 | 960 | 1110 |
| raffinate product | | | |
| comparative example | 980 | 2339 | 1131 |
| example | 980 | 1282 | 1131 |

As has been noted above, the aspects of the invention relating to improved continuity in process flows is seen to be of substantial practical advantage when consideration is given to downstream processing of adsorbate and raffinate products, e.g., for purposes of heat conservation, eluent recovery, etc. Since both product streams are vapor-phase, it is particularly difficult to dampen substantial discontinuities in flowrate and concentration which result from the sequential switching through the various process steps of the prior art.

I claim as my invention:

1. An improved process for using three molecular sieve adsorbent beds to effect the resolution of a continuous flow of a vapor-phase hydrocarbon feed mixture containing normal paraffins and non-normal paraffin hydrocarbons into an adsorbate product fraction comprising normal paraffins and a raffinate product fraction comprising non-normal paraffin hydrocarbons, which process comprises repeated sequential performance of the following steps:

step one, in which
- the feed mixture is passed through a first adsorbent bed,
- effluent is withdrawn from the first bed and passed through a second adsorbent bed
- a continuous flow of eluent is passed through a third adsorbent bed,
- adsorbate product is withdrawn as an effluent from the third bed, and
- raffinate product is withdrawn as an effluent from the second bed;

step two, in which
- the feed mixture is passed through the second bed,
- the eluent flow is passed through the third bed,
- effluent from the third bed is withdrawn and divided into an adsorbate product fraction, which contains between 60 and 95 volume percent of the effluent from the third bed, and a purge fraction which contains between 5 and 40 volume percent of the effluent from the third bed,
- the purge fraction is passed through the first bed,
- effluent from the first bed is withdrawn and is passed through the second bed, and
- raffinate product is withdrawn as effluent from the second bed;

step three, in which
- the feed mixture is passed through the second bed,
- effluent is withdrawn from the second bed and passed through the third bed,
- the eluent flow is passed through the first bed,
- adsorbate product is withdrawn as an effluent from the first bed, and
- raffinate product is withdrawn as an effluent from the third bed;

step four, in which
- the feed mixture is passed through the third bed,
- the eluent flow is passed through the first bed,
- effluent from the first bed is withdrawn and divided into an adsorbate product fraction, which contains between 60 and 95 volume percent of the effluent from the first bed, and a purge fraction which contains between 5 and 40 volume percent of the effluent from the first bed,
- the purge fraction is passed through the second bed,
- effluent from the second bed is withdrawn and is passed through the third bed, and
- raffinate product is withdrawn as effluent from the third bed;

step five, in which
- the feed mixture is passed through the third bed,
- effluent is withdrawn from the third bed and passed through the first bed,
- the eluent flow is passed through the second bed, adsorbate product is withdrawn as an effluent from the second bed, and raffinate product is withdrawn as an effluent from the first bed; and step six, in which the feed mixture is passed through the first bed, the eluent flow is passed through the second bed, effluent from the second bed is withdrawn and divided into an adsorbate product fraction, which contains between 60 and 95 volume percent of the effluent from the second bed, and a purge fraction, which contains between 5 and 40 volume percent of the effluent from the second bed, the purge fraction is passed through the third bed, effluent from the third bed is withdrawn and is passed through the first bed, and raffinate product is withdrawn as effluent from the first bed.

2. The process of claim 1, wherein the eluent flow has a mass flowrate between about four and eight times the mass flowrate of the normal paraffins in the feed mixture.

3. The process of claim 1, wherein the adsorbate product fraction contains between about 65 and 90 volume percent and the purge fraction contains between about 10 and 35 volume percent of the effluent flow from the third bed in step two, from the first bed in step four, and from the second bed in step six.

4. The process of claim 2, wherein the adsorbate product fraction contains between about 70 and 85 volume percent and the purge fraction contains between about 15 and 30 volume percent of the effluent flow from the third bed in step one, from the first bed in step four, and from the second bed in step six.

5. The process of claim 2, wherein the normal paraffins have between about 8 and 20 carbon atoms.

6. The process of claim 5, wherein the hydrocarbon feed mixture is kerosene.

7. The process of claim 6, wherein the normal paraffins have between about 11 and 15 carbon atoms.

* * * * *